US007081854B2

(12) United States Patent
Ying et al.

(10) Patent No.: US 7,081,854 B2
(45) Date of Patent: Jul. 25, 2006

(54) PRINTED BUILT-IN ANTENNA FOR USE IN A PORTABLE ELECTRONIC COMMUNICATION APPARATUS

(75) Inventors: Zhinong Ying, Lund (SE); Kenneth Håkansson, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/512,710

(22) PCT Filed: Apr. 25, 2003

(86) PCT No.: PCT/EP03/04298

§ 371 (c)(1),
(2), (4) Date: Oct. 27, 2004

(87) PCT Pub. No.: WO03/094289

PCT Pub. Date: Nov. 13, 2003

(65) Prior Publication Data

US 2005/0212706 A1 Sep. 29, 2005

Related U.S. Application Data

(60) Provisional application No. 60/379,138, filed on May 9, 2002.

(30) Foreign Application Priority Data

May 2, 2002 (EP) ..... 02009863

(51) Int. Cl.
*H01Q 1/24* (2006.01)

(52) U.S. Cl. ..... 343/702; 343/700 MS

(58) Field of Classification Search ..... 343/700 MS, 343/702, 846, 848

See application file for complete search history.

(56) References Cited

U.S. PATENT DOCUMENTS

| | | | | |
|---|---|---|---|---|
| 5,844,525 | A * | 12/1998 | Hayes et al. | 343/702 |
| 6,195,048 | B1 | 2/2001 | Chiba et al. | |
| 6,535,167 | B1 * | 3/2003 | Masuda et al. | 343/700 MS |
| 6,535,172 | B1 * | 3/2003 | Hirabayashi | 343/725 |
| 6,774,850 | B1 * | 8/2004 | Chen | 343/700 MS |
| 6,867,746 | B1 * | 3/2005 | Mendolia et al. | 343/841 |
| 2001/0043159 | A1 | 11/2001 | Masuda et al. | |
| 2001/0050635 | A1 | 12/2001 | Weinberger | |
| 2003/0157903 | A1 * | 8/2003 | Begic | 455/90 |
| 2004/0108957 | A1 * | 6/2004 | Umehara et al. | 343/700 MS |

FOREIGN PATENT DOCUMENTS

| | | |
|---|---|---|
| EP | 06334421 | 12/1994 |
| EP | 9 757 405 | 2/1997 |
| EP | 0 892 459 | 1/1999 |
| EP | 0 997 974 | 5/2000 |
| EP | 1 191 627 A2 | 3/2002 |
| WO | WO 01/91233 | 11/2001 |

* cited by examiner

*Primary Examiner*—Tan Ho
(74) *Attorney, Agent, or Firm*—Myers Bigel Sibley & Sajovec

(57) ABSTRACT

An antenna for use in a portable electronic communication apparatus has a pattern of a conductive material. The pattern of conductive material is printed on the Printed Circuit Board (PCB) (7), comprising the RF circuitry of the portable electronic communication apparatus, to which antenna pattern is connected. The pattern comprises a first and second antenna arm, which together for a PIFA antenna and are resonating in a first and second frequency band, respectively. As an alternative, the antenna pattern forms a multi-port antenna having separate antenna arms for Rx and Tx, respectively.

22 Claims, 4 Drawing Sheets

PRINTED BUILT-IN ANTENNA FOR USE IN A PORTABLE ELECTRONIC COMMUNICATION APPARATUS

RELATED APPLICATIONS

The present application is a 35 U.S.C. §371 national phase application of PCT International Application No. PCT/EP03/04298, having an international filing date of Apr. 25, 2003 and claiming priority to European Patent Application No. 02009863.8, filed May 2, 2002, and to U.S. Provisional Application No. 60/379,138 filed May 9, 2002, the disclosures of which are incorporated herein by reference in their entireties. The above PCT International Application was published in the English language and has International Publication No. WO 03/094289 A1.

TECHNICAL FIELD

The invention relates to an antenna for use in a portable electronic communication apparatus such as a mobile telephone. More specifically, the invention relates to a built-in antenna comprising a pattern of conductive material, which is printed on the printed circuit board (PCB) of the portable electronic communication apparatus. The invention also relates to a portable electronic communication apparatus comprising such a printed built-in antenna.

PRIOR ART

A portable electronic communication apparatus, such as a mobile telephone, requires some sort of antenna in order to establish and maintain a wireless radio link with another unit in the communication system, normally a base station. In the telecommunication industry, the demand for mobile telephones that are small in size, light in weight, and inexpensive to manufacture are continuously present. To this end, printed built-in antennas are utilized for mobile telephones within the 300–3000 MHz frequency range. Printed built-in antennas known in the art comprises microstrip patch antennas and planar inverted-F antennas (PIFA).

As the mobile telephones becomes smaller and smaller, both conventional microstrip patch and PIFA antennas are still too large to fit small mobile telephone chassis. This is particularly problematic when the new generation of mobile telephones needs multiple antennas for cellular, wireless local are network, GPS and diversity.

The antenna pattern of the antennas according to the above are printed on a support member separated from the main printed circuit board (PCB) of the mobile telephone. After manufacturing, the antenna can be connected to the PCB by utilizing connectors, such as pogo-pins.

Disadvantages of built-in antennas known in the art are that both the connectors and the assembling of the antenna and the PCB add considerable cost to the mobile telephone. Also, the mechanical tolerances involved in the assembling of the conventional built-in antenna and the PCB effect the performance of the antenna negatively. That is, it is difficult to obtain exactly the same position of the antenna in relation to the signal source, and sufficient connection of the pogo-pins. Also, in antenna configurations known in the art, the space between the antenna and the PCB is not utilized effectively, by e.g. positioning electronic components in between them.

Further, as it becomes more and more common with multi-port antennas in portable electronic communication apparatuses, i.e. antennas having separate antenna arms for each Rx (receiver unit) and Tx (transmitter unit), the number of connectors is increasing and consequently the cost and the problem with mechanical tolerances.

SUMMARY OF THE INVENTION

It is an object of the present invention to provide a built-in antenna having a printed pattern of conductive material with good radiation characteristics in at least one frequency band, which is inexpensive to manufacture and utilizes the interior space of an electronic communication apparatus effectively. More specifically, it is an object of the invention to provide an antenna, which can be connected to the RF circuits of the printed circuit board (PCB) of the apparatus without any conventional connectors, such as pogo-pins. A further object of the invention is to eliminate the mechanical tolerances involved with the assembly of the antenna and the PCB.

Another object of the invention is to provide a portable electronic apparatus comprising a PCB and a built-in antenna, which can be connected to said PCB without any connectors.

The above objects are achieved by providing an antenna adapted to be built-in and used in a portable electronic communication apparatus. The antenna comprises a pattern of a conductive material printed directly on the PCB of the portable electronic communication apparatus, which comprises the RF circuits of the apparatus. Further, the above objects are achieved by providing an extended ground plane connected to the main ground plane of the PCB and situated parallel to and opposite the antenna pattern. The antenna pattern and the extended ground plane are positioned with a distance in relation to each other, and form a space, in which low profile electronic components can be positioned.

The above objects are also achieved by a portable electronic communication apparatus comprising a PCB having RF circuits connected to an built-in antenna, which is printed on the PCB of the apparatus and connected to the RF circuits. Also, the apparatus of the invention comprises an extended ground plane, which provides good radiation characteristics for the antenna.

By providing the inventive antenna manufacturing costs of the portable electronic communication apparatus is lowered and the interior space of the apparatus is utilized more effectively.

As an alternative, the antenna pattern can be provided to form a multi-port antenna comprising antenna arms having four connections to the circuitry of the PCB. In this embodiment the cost savings in relation the known art will be even bigger. Also, as no connectors, such as pogo-pins are needed, the insertion loss is lowered. Further, by providing separate antenna patterns for the Rx and Tx circuits respectively, it is possible to connect the antenna to the Rx and Tx circuitry respectively, without having an antenna switch, which will lower the cost of the mobile phone even more.

Further preferred features of the invention are defined in the dependent claims.

It should be emphasized that the term "comprises/comprising" when used in this specification is taken to specify the presence of stated features, integers, steps, components or groups thereof.

BRIEF DESCRIPTION OF THE DRAWINGS

Preferred embodiments of the present invention will now be described in more detail with reference to the accompanying drawings, in which.

DETAILED DISCLOSURE

Figure 1:
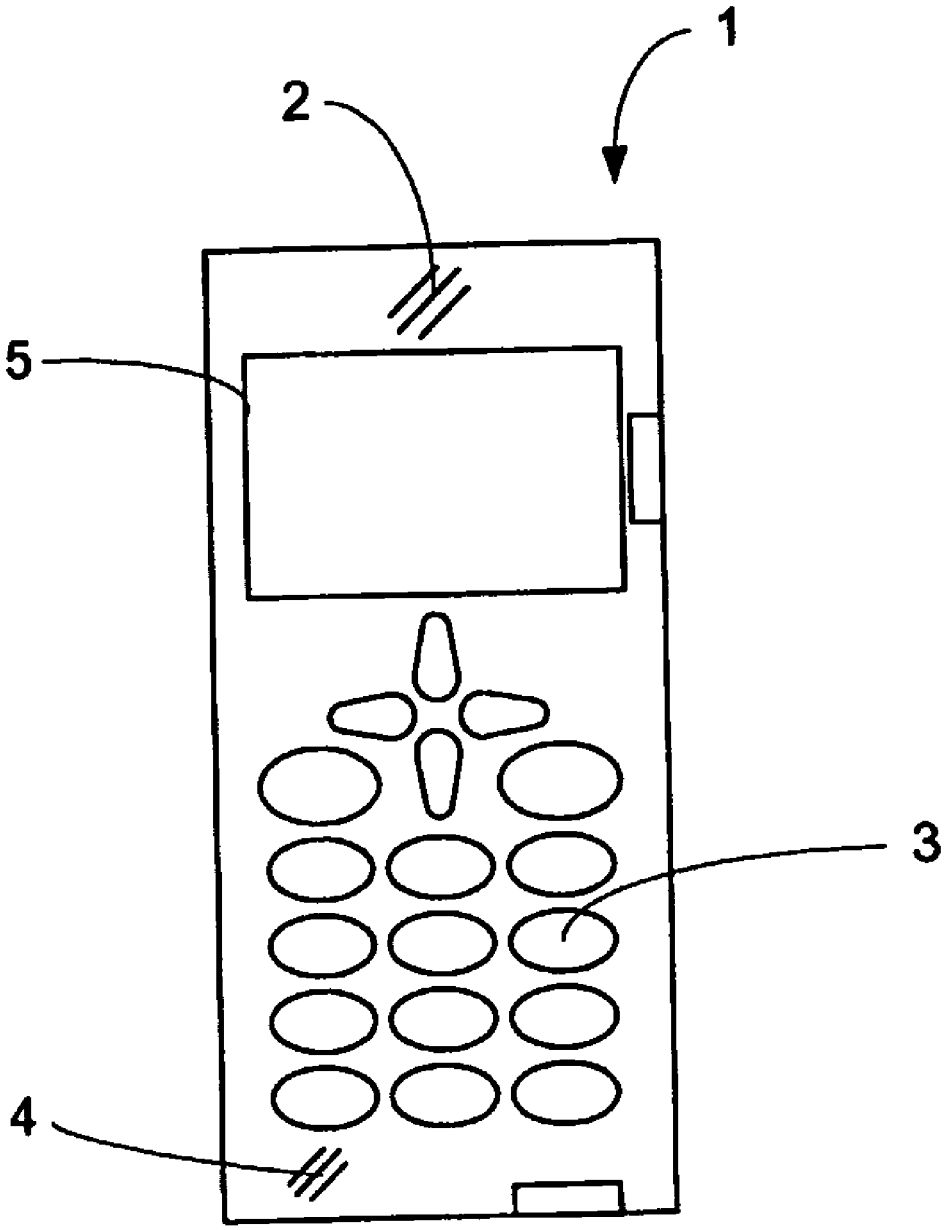
FIG. 1 shows a mobile telephone having a built-in antenna according to the invention.

FIG. 1 illustrates a mobile telephone 1 as one example in which the printed built-in antenna according to the invention may be used. However, the inventive antenna may be used in virtually any other portable electronic communication apparatus, in which a built-in antenna is preferred.

The mobile telephone 1 shown in FIG. 1 comprises a loudspeaker 2, a keypad 3, a microphone 4, and a display 5 as is generally known in the art. Further, the mobile telephone 1 comprises the antenna according to the invention, which is built-in into the chassis of the mobile telephone 1.

Figure 2:
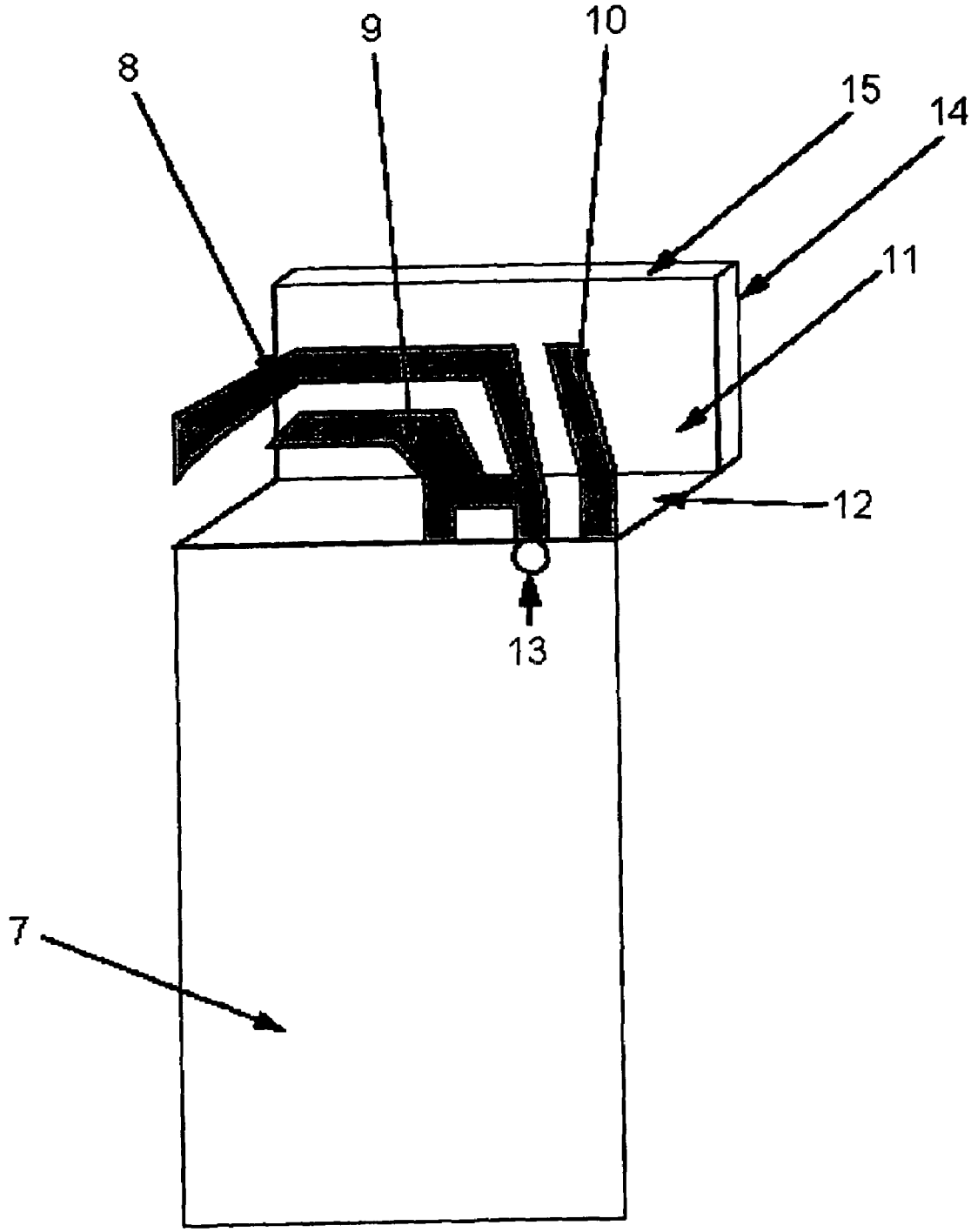
FIG. 2 illustrates a PIFA antenna printed on the main PCB of the mobile phone in FIG. 1.

FIG. 2 illustrates a multi-band printed built-in antenna according to a first embodiment of the invention. The antenna comprises a pattern of conductive material printed directly on the main printed circuit board (PCB) 7 of the mobile telephone 1. In FIG. 2, the PCB 7 is shown as ending at the beginning of the antenna pattern. However, as is apparent to the man skilled in the art, this is only for illustrative purposes. In a real application the PCB 7 extends over the full extension of the entire antenna pattern, as the antenna pattern is printed on the PCB 7.

In the embodiment of FIG. 2 the antenna pattern comprises at a first plane a dual-band PIFA (Planar Inverted-F Antenna) antenna having a first arm 8 and a second arm 9, which are resonant in a first and second frequency band, respectively. Also, to provide a third frequency band, at which the antenna is resonant, the antenna pattern comprises a parasitic element 10, which is capacitively coupled to the main PIFA. Further, to provide good radiation characteristics, e.g. directed radiation, and a ground plane under the antenna pattern an extended ground plane 11 is provided at a second plane, essentially parallel to the first plane and opposite the antenna pattern.

The first and second antenna arms 8, 9 of the conductive pattern are printed directly on a first side of the main PCB 7. The main PCB 7 has a main ground plane, to which the second antenna arm 9 is connected. The first antenna arm 8 is connected to the RF port 13 of the main PCB 7. The connection between the antenna pattern and the patches of the PCB 7 is e.g. provided by connection strips, which provide sufficient connection between the antenna and the RF circuits of the PCB to not have an effect on the antenna tuning such as impedance matching and bandwidth. By printing the conductive pattern of the antenna directly on the main PCB 7, it is possible to connect the antenna arms 8, 9 to a RF port 13 and ground plane of the PCB 7, respectively, without any conventional connectors, such as pogo-pins. The RF circuitry of the mobile telephone 1 as such forms no essential part of the present invention and is therefore not described in detail herein.

As will be readily realized by the man skilled in the art, the RF circuitry will comprise various known HF (high frequency) components and base band components suitable for receiving a frequency signal, filtering the received signal, demodulating the received signal into a baseband signal, filtering the baseband signal further, converting the baseband signal to digital form, applying digital signal processing to the digitized baseband signal (including channel and speech decoding), etc. Conversely, the HF and baseband components of the radio circuitry will be capable of applying speech and channel encoding to a signal to be transmitted, modulating it onto a carrier wave signal, supplying the resulting HF signal to the antenna, etc.

In the first embodiment shown in FIG. 2, the antenna is designed to have an input impedance of 50 ohm, without any impedance matching circuit. The first antenna arm 8 is designed to be resonant in a first frequency band at around 900 Mhz (GSM), and the second antenna arm 9 is designed to be resonant in a second frequency band at around 1800 Mhz (DCS). However, the design and tuning of the embodiment in FIG. 2 is only exemplifying, and is not considered to limit the scope of the invention. Other designs of the printed antenna arms are equally well possible within the scope of the invention.

As an option, the antenna in FIG. 2 comprises the parasitic element 10, which is printed on a second side of the main PCB 7. Therefore, in this embodiment the main PCB is at least a dual-layer PCB. The parasitic element 10 is connected to the ground plane of the PCB 7, by e.g. a connection strip, and capacitively coupled to the main PIFA. Since the main PIFA and the parasitic element 10 are positioned on opposite sides of the PCB 7, the distance between them is the thickness of the PCB.

For tuning purposes of the bandwidth of the antenna, the parasitic element is positioned with a longitudinal displacement opposite the antenna pattern of the first side of the PCB 7 as can be seen in FIG. 2. Also, the length of the parasitic element 10 will effect the natural frequency of said element 10 and the bandwidth of the antenna. The parasitic element 10 widens the bandwidth of the second antenna arm 9, which adds the third frequency band, at which the antenna is resonant. Here, the third frequency band is at around 1900 MHz (PCS). However, the exact design of the parasitic element 10 forms no essential part of the invention. FIG. 2 is only showing an exemplifying embodiment and is not considered to limit the scope of the invention.

By printing the antenna pattern on the main PCB, the antenna is always positioned in the same position every time. Therefore, the mechanical tolerances involved with the connection of an antenna known in the art to the PCB can be substantially eliminated, which also improves the performance of the antenna. For example, a bad connection between the circuits of the PCB and the antenna will not occur and the antenna pattern will always be positioned in exactly the same position in relation to the signal source.

As is known to the man skilled in the art, it is preferred to provide a ground plane under the antenna pattern of a PIFA antenna. Therefore, the extended ground plane 11 having a first and second end, respectively, is provided essentially parallel to the PCB, and positioned opposite the antenna pattern at the second side of the PCB 7. This will also provide good radiation characteristics of the antenna, e.g. by directing the radiation in a preferred direction. The size of the extended ground plane 11 is at least as big as the size of the antenna pattern, and the shape of said plane 11 corresponds essentially to the shape of said pattern. A smaller extended ground plane 11 is possible, however it will have a negative effect on the bandwidth of the antenna.

The distance between the PCB 7 and the extended ground plane 11 is preferably in the range of 6–10 mm. A smaller distance will decrease the bandwidth of the antenna, and a larger distance is not necessary and will only effect the dimensions of the antenna. In this embodiment, the extended ground plane 11 comprises a metal layer mounted on a carrier, such as a piece of dielectric material. However, other configurations of conductive material, which can provide a ground plane 11 can be utilized. The material of the extended ground plane 11 should have good reflection properties of electromagnetic radiation, such as copper. This will direct the radiation of the antenna in a preferred direction and the antenna efficiency will increase.

As can be seen in FIG. 2, the first end of the extended ground plane 11 is connected to the ground plane of the main PCB 7 through a distance portion 12, which will provide sufficient distance between the extended ground plane 11 and the PCB 7. Also, the distance portion 12 will provide connection between the extended ground plane 11 and the ground plane of the PCB 7. A first end of the distance portion 12 is connected to the PCB 7, preferably at the connection point of the parasitic element 10 to the ground plane of the PCB 7, as can be seen in FIG. 2, and is extending substantially orthogonal from the second side of the PCB 7. However, other angles are also possible as long as sufficient distance between the PCB 7 and the extended ground plane 11 is obtained. A second end of the distance portion 12 is connected to the first end of the extended ground plane 11. In the first embodiment, the distance portion 12 is made of a conductive material, such as copper, for connecting the ground plane of the PCB 7 and the extended ground plane 12. Also, it is possible that the distance portion 12 forms part of the extended ground plane 11, which then is provided e.g. as a bent metal layer.

To further improve the antenna characteristics, a second conductive layer 14, similar to the first conductive layer of the extended ground plane 11, can as an option be provided substantially parallel to and opposite said first conductive layer of the extended ground plane 11 to form a microwave choke. This second layer 14 is also connected to the second end of the distance portion 12, and consequently to the ground plane of the main PCB 7. The second conductive layer has preferably the same size and form as the first conductive layer and form a slot therewith. The distance between the conductive layers is small, preferably not more than 1 mm. Between the conductive layers is a dielectric member 15 provided, e.g. in form of the support element described above.

Between the extended ground plane 11 and the PCB, it is possible to position electronic components of the mobile telephone 1 having a low profile in the range of up to approximately 3 mm, such as a buzzer. By positioning suitable electronic components between the PCB 7 and the extended ground plane 11, the interior space of the mobile telephone will be better utilized.

The first embodiment disclosed in FIG. 2 provides a small and efficient antenna, which is inexpensive to manufacture and provides good radiation characteristics in several frequency bands. A Smith chart and a SWR (standing wave ratio) diagram in FIG. 4 illustrate the performance of a prototype of the antenna in FIG. 2.

As is well known to the man skilled in the art, a SWR diagram illustrates the frequencies at which an antenna is resonating. The SWR diagram of FIG. 4 represents the return loss in dB as a function of frequency. The lower dB values in a SWR diagram, the better. In a SWR diagram, a resonance is an area, within which the return loss is low (a high negative value in dB). In the SWR diagram of FIG. 4 this looks look like steep and deep cavities. As is apparent, the antenna according to the invention has good resonating properties in the GSM band at around 880–960 MHz, the DCS band at around 1710–1880 MHz, and the PCS band at around 1850–1990 MHz.

Figure 4:
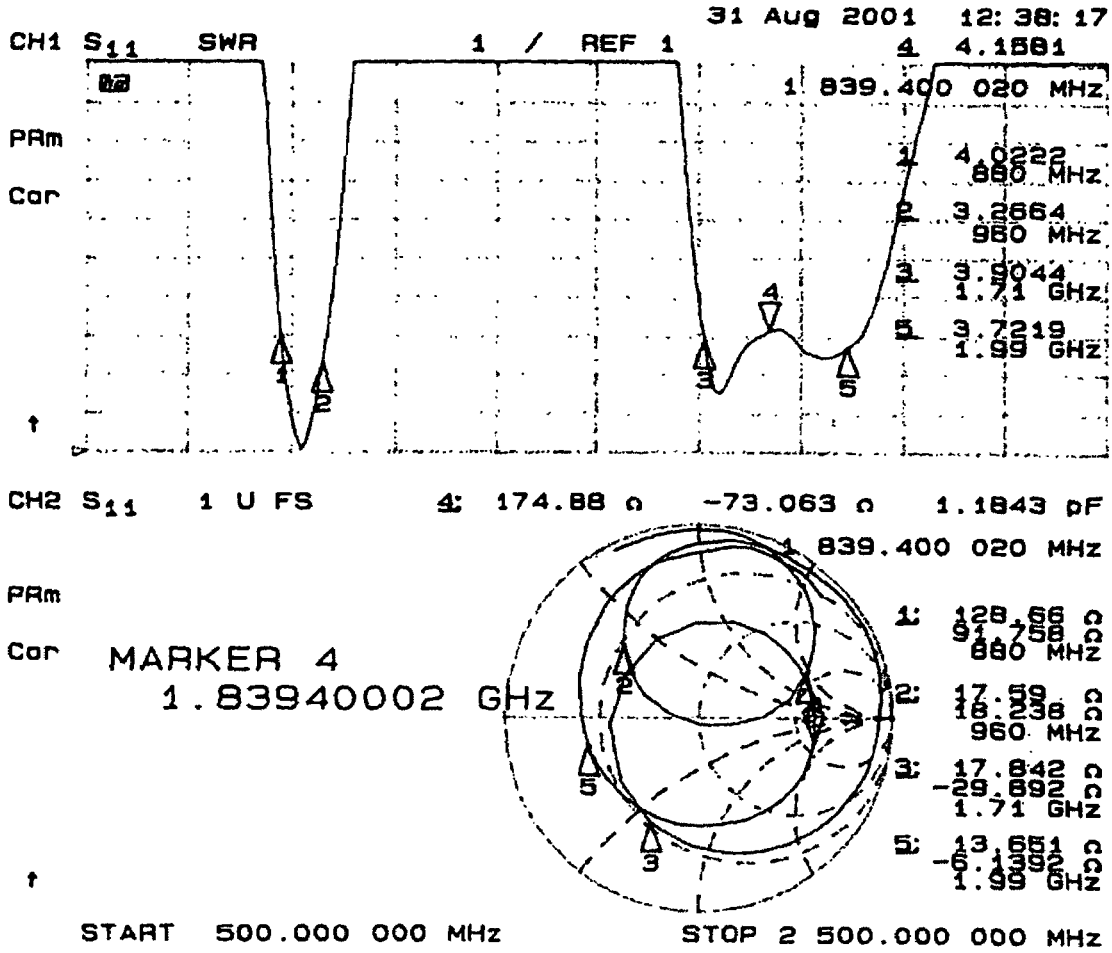
FIG. 4 is a SWR diagram and a Smith chart representing the performance of the embodiment shown in FIG. 2.

Briefly speaking, in the Smith chart of FIG. 4 the circles represent different frequencies, in which the antenna of FIG. 2 is operating. The horizontal axis represents pure resistance (no reactance). Of particular importance is the point at 50 Ω (the middle of the horizontal axis), which normally represents an ideal input impedance. As can be seen in FIG. 4, the first embodiment of the antenna is tuned to have an input impedance of 50 Ω without any impedance matching circuit.

Figure 3:
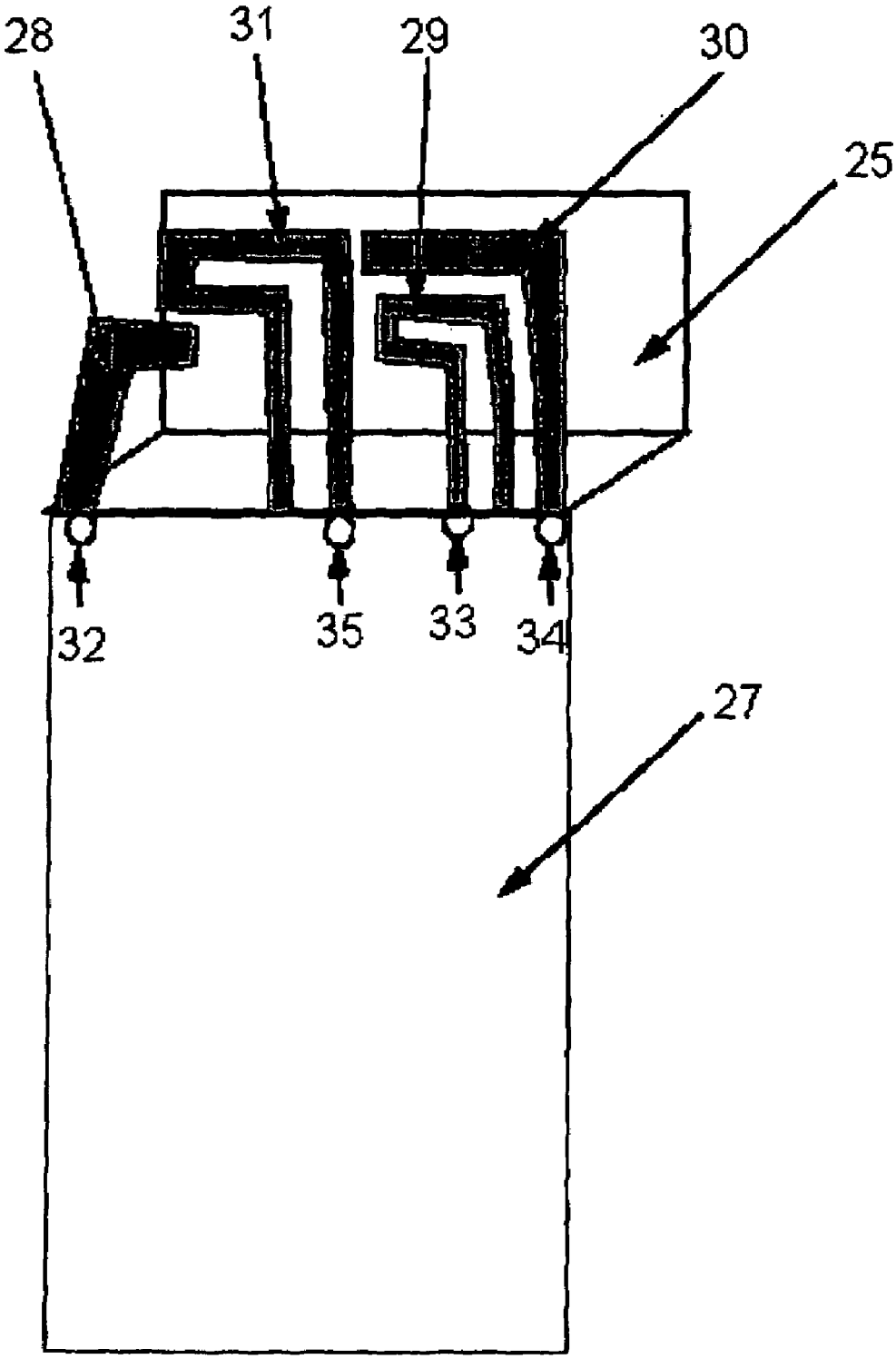
FIG. 3 illustrates a multi-port antenna printed on the main PCB of the mobile phone in FIG. 1.

As is mentioned previously, the specific design of the antenna pattern is not fundamental to the present invention. The design of the antenna pattern is different in each individual case to tune the antenna in a preferred frequency band. To illustrate this, a second alternative embodiment of the inventive antenna is disclosed in FIG. 3. Again, the PCB 27 is shown as ending at the beginning of the antenna pattern, as in FIG. 2. However, as is apparent to the man skilled in the art, this is only for illustrative purposes. In a real application the PCB 27 extends over the full extension of the entire antenna pattern, as the antenna pattern is printed on the PCB 27.

The built-in printed multi-port antenna comprises in a similar fashion as the multi-band antenna in FIG. 2 an antenna pattern printed on the main PCB 27 of the mobile telephone 1. However, the antenna pattern of the multi-port antenna comprises different antenna arms for different frequency bands and each Rx and Tx.

The multi-port antenna is a dual-band antenna having four multi-port antenna arms 28, 29, 30, 31, i.e. two for the lower frequency band and two for the higher frequency band. In this embodiment no parasitic element is provided. However, the man skilled in the art easily implements this by providing a dual-layer PCB with a parasitic element printed on the PCB 27 opposite the main antenna pattern. Also, the multi-port antenna comprises an extended ground plane 25 having one, or two (not shown), conductive layers similarly to the first embodiment in FIG. 2, connected to the main ground plane of the PCB 27.

Each of the multi-port antenna arms 28, 29, 30, 31 are connected to Rx and Tx ports 32, 33, 34, 35, respectively, of the PCB 27 by connection strips, as described above.

The present invention has been described above with reference to a first embodiment and an alternative embodiment. However, many alternative embodiments not described herein are equally possible within the scope of the invention, as defined by the appended independent claims. Particularly as regards the specific geometrical dimensioning of the pattern of conductive material, which makes up the antenna, the various dimensions will have to be carefully selected depending on the actual application. Moreover, the frequency bands in which the antenna is operative may also be greatly varied depending on the actual application. Therefore, the antenna pattern has to be tuned for the actual application, which is believed to be routine actions by the man skilled in the art and is therefore not further disclosed herein.

In the drawings, some of the dimensions and the distance between different parts of the antenna, such as the distance between the PCB 7, 27 and the extended ground plane 11, 25, are highly exaggerated for illustrative purposes, and are not to be considered effecting the scope of the invention.

The invention claimed is:

1. A built-in antenna for use in a portable electronic communication apparatus, the antenna comprising:

an antenna pattern of a conductive material printed on a Printed Circuit Board (PCB) having a ground plane; and an extended ground plane comprising at least one conductive layer, which is connected to the ground plane of the PCB, the extended ground plane being arranged at a distance from and substantially parallel to the PCB and opposite the antenna pattern.

2. The antenna according to claim 1, wherein the conductive layer is connected to the ground plane of the PCB via a distance portion having a first end connected to the ground plane of the PCB and extending substantially orthogonal away from the PCB, and a second end connected to the conductive layer of the extended ground plane.

3. The antenna according to claim 2, wherein the distance portion comprises metal.

4. The antenna according to claim 3, wherein the at least one conductive layer and the distance portion each comprise copper.

5. The antenna according to claim 1, wherein the size of the extended ground plane at least corresponds to the size of the antenna pattern, and the shape of the extended ground plane corresponds to the shape of the antenna pattern.

6. The antenna according to claim 1, wherein the distance between the PCB and the extended ground plane is in a range of 6–10 mm.

7. The antenna according to claim 1, wherein the extended ground plane comprises a second conductive layer positioned parallel and opposite to a first conductive layer, said second conductive layer is connected to the ground plane of the PCB, and the size and the shape of said second conductive layer correspond to the size and shape of the first conductive layer.

8. The antenna according to claim 7, wherein a dielectric member having a thickness of not more than 1 mm is positioned between the first and the second conductive layers of the extended ground plane.

9. The antenna according to claim 1, wherein the at least one conductive layer comprises metal.

10. The antenna according to claim 1, wherein the portable electronic communication apparatus comprises a mobile telephone.

11. The antenna according to claim 1 wherein the extended ground plane is spaced apart from the Printed Circuit Board (PCB).

12. A portable electronic communication apparatus for use in a wireless telecommunication system, the portable electronic communication apparatus comprising:

a built-in antenna comprising an antenna pattern of a conductive material printed on a Printed Circuit Board (PCB) having a ground plane, and an extended ground plane comprising at least one conductive layer, which is connected to the ground plane of the PCB, the extended ground plane being arranged at a distance from and substantially parallel to the PCB and opposite the antenna pattern; and radio frequency (RF) circuitry coupled to the built-in antenna.

13. The portable electronic communication apparatus according to claim 12, wherein the conductive layer is connected to the ground plane of the PCB via a distance portion having a first end connected to the ground plane of the PCB and extending substantially orthogonal away from the PCB, and a second end connected to the conductive layer of the extended ground plane.

14. The portable electronic communication apparatus according to claim 13, wherein the distance portion comprises metal.

15. The portable electronic communication apparatus according to claim 14, wherein the at least one conductive layer and the distance portion each comprise copper.

16. The portable electronic communication apparatus according to claim 12, wherein the size of the extended ground plane at least corresponds to the size of the antenna pattern, and the shape of the extended ground plane corresponds to the shape of the antenna pattern.

17. The portable electronic communication apparatus according to claim 12, wherein the distance between the PCB and the extended ground plane is in a range of 6–10 mm.

18. The portable electronic communication apparatus according to claim 12, wherein the extended ground plane comprises a second conductive layer positioned parallel and opposite to a first conductive layer, said second conductive layer is connected to the ground plane of the PCB, and the size and the shape of said second conductive layer correspond to the size and shape of the first conductive layer.

19. The portable electronic communication apparatus according to claim 18, wherein a dielectric member having a thickness of not more than 1 mm is positioned between the first and the second conductive layers of the extended ground plane.

20. The portable electronic communication apparatus according to claim 12, wherein the at least one conductive layer comprises metal.

21. The portable electronic communication apparatus according to claim 12, wherein the portable electronic communications apparatus comprises a mobile telephone.

22. The portable electronic communication apparatus according to claim 12 wherein the extended ground plane is spaced apart from the Printed Circuit Board (PCT).

* * * * *